US008547803B2

(12) United States Patent
Pesenti et al.

(10) Patent No.: US 8,547,803 B2
(45) Date of Patent: Oct. 1, 2013

(54) STRIKING MECHANISM FOR A WATCH WITH AN ACTIVE DAMPER COUNTER-SPRING

(75) Inventors: Jean-François Pesenti, Morbier (FR); Sylvain Maréchal, Bois d'Amont (FR); Nakis Karapatis, Premier (CH); Jérôme Favre, Les Bioux (CH)

(73) Assignee: Montres Breguet S.A., L'Abbaye (CH)

( * ) Notice: Subject to any disclaimer, the term of this patent is extended or adjusted under 35 U.S.C. 154(b) by 279 days.

(21) Appl. No.: 13/036,263

(22) Filed: Feb. 28, 2011

(65) Prior Publication Data

US 2011/0211427 A1 Sep. 1, 2011

(30) Foreign Application Priority Data

Feb. 26, 2010 (EP) ..... 10154767

(51) Int. Cl.
*G04B 21/00* (2006.01)

(52) U.S. Cl.
USPC ..... 368/243; 368/267; 368/269

(58) Field of Classification Search
USPC ..... 368/267–271, 243, 75, 98, 273
See application file for complete search history.

(56) References Cited

U.S. PATENT DOCUMENTS

| | | | | |
|---|---|---|---|---|
| 641,478 | A | 1/1900 | Torres | |
| 7,065,005 | B2 * | 6/2006 | Rochat | 368/72 |
| 7,292,505 | B2 * | 11/2007 | Schmiedchen | 368/110 |

FOREIGN PATENT DOCUMENTS

| | | | |
|---|---|---|---|
| EP | 1 574 917 | A2 | 9/2005 |
| EP | 2 048 548 | A2 | 4/2009 |
| EP | 2048548 | A2 * | 4/2009 |

OTHER PUBLICATIONS

Search Report issued in corresponding European Application No. 10154767, completed Aug. 20, 2010.

* cited by examiner

*Primary Examiner* — Vit W Miska

(74) *Attorney, Agent, or Firm* — Griffin & Szipl, P.C.

(57) ABSTRACT

The watch striking mechanism (1) includes a gong, which is fixed via one end thereof to a gong-carrier integral with a plate, a hammer rotatably mounted on the plate to strike the gong at determined times, a damper counter-spring (5) for keeping the hammer away from the gong in an idle mode, and a drive spring (3) for the hammer. The drive spring includes an end (3*b*) fixed to the plate and an end (3*a*) that is free to move. The spring can be wound so that the free end (3*a*) of the spring drives the hammer (2) against the gong (21) in a strike mode to produce an acoustic sound. The striking mechanism includes means (10) for actuating the damper counter-spring (5) in a strike mode with a time lag after the hammer (2) strikes the gong, so that after the hammer strikes the gong, the counter-spring pushes said hammer towards an idle position. The actuating means includes a stop member mounted on the damper counter-spring to be actuated via the drive spring when in action just after the hammer strikes the gong.

13 Claims, 6 Drawing Sheets

STRIKING MECHANISM FOR A WATCH WITH AN ACTIVE DAMPER COUNTER-SPRING

This application claims priority from European Patent Application No. 10154767.7 filed Feb. 26, 2010, the entire disclosure of which is incorporated herein by reference.

FIELD OF THE INVENTION

The invention concerns a striking mechanism for a watch provided with an active damper counter-spring. The mechanism includes at least one hammer arranged to strike at least one gong secured to a gong-carrier at determined times. Said hammer is held away from the gong by said damper counter-spring in an idle mode. A drive spring for the hammer of the mechanism can be configured in the form of a resilient strip or beam. This drive spring can be wound to drive said hammer against the gong to provide an acoustic signal, for example, of a programmed time period.

BACKGROUND OF THE INVENTION

Within the field of watchmaking, a striking mechanism can be combined with a conventional watch movement to act as a minute repeater or to indicate a programmed alarm time. This type of striking mechanism generally includes at least one gong made of metallic material, such as steel, bronze, precious metal, metallic glass, sapphire or quartz. The gong may describe, for example, at least one portion of a circle around the watch movement inside the watch frame. The gong is secured by at least one end thereof to a gong-carrier, which is in turn secured to a watch plate. A strike-hammer is rotatably mounted on the plate, for example, in proximity to the gong-carrier so as to strike the gong and cause it to vibrate. The sound produced when the gong is struck by the hammer is within the audible frequency range of 1 kHz to 20 kHz. This indicates a well defined time, a programmed alarm or a minute repeater to the person wearing the watch.

As shown in EP Patent No 1 574 917, the striking mechanism of a watch may include two gongs each secured via one end thereof to the same gong-carrier, which is in turn secured to a plate. Each gong may be struck by a respective hammer. To achieve this, each hammer is driven by its own drive spring, which must have been pre-wound, so as to drive the hammer against the gong to indicate a minute repeater or an alarm time. Two damper counter-springs are each provided to push back and hold the two hammers away from the gongs in an idle mode. The damper counter-springs also slow down the fall of each hammer before it strikes the respective gong and then push the hammer back into the idle position. Eccentrics are also provided for adjusting the operation of the counter-springs to prevent each hammer from rebounding against the respective gong.

One drawback of this type of striking mechanism structure with counter-springs is that there is a significant loss of kinetic energy when the hammer strikes the respective gong, which reduces the acoustic level of the striking work. This energy loss is largely due to the slowing down imposed by each counter-spring on the path of the hammer when it strikes the gong. Moreover, even if the pre-winding of the drive springs is increased, this involves adapting the counter-springs via their eccentric, also to prevent any rebound, which is another drawback of this type of striking mechanism.

EP Patent No. 2 048 548, which mainly discloses a hammer of a watch striking mechanism may also be cited. This hammer includes two parts hinged to each other and a resilient member secured to one of the hinged parts. When the hammer is in a stable position, the resilient spring member holds the two parts of the hammer, whereas when the hammer is in the striking position, the two parts move away from each other, returned by the resilient spring member. With this arrangement, it is possible to reduce the kinetic energy that the hammer loses against a damper member. However, this type of hammer arrangement complicates the fabrication of the striking mechanism to prevent the hammer losing energy when it strikes the gong, which is a drawback. Undesirable rebounds of the hammer against the gong may also occur during the strike, which is another drawback.

SUMMARY OF THE INVENTION

It is thus an object of the invention to overcome the drawbacks of the aforementioned state of the art by providing a watch striking mechanism, which includes means for increasing the acoustic level of the sound produced by at least one gong struck by at least one hammer, and prevents the hammer from rebounding and losing energy during the strike.

The invention therefore concerns a watch striking mechanism, which includes:

- a gong, which is connected to a gong-carrier,
- a hammer mounted on a plate to strike the gong at predetermined times,
- a damper counter-spring for keeping the hammer away from the gong in an idle mode, and
- a drive spring for the hammer, which includes a fixed end and an end that is free to move, said spring being able to be wound to drive said hammer against the gong in a strike mode to produce an acoustic sound, wherein it includes means for actuating the damper counter-spring in a strike mode with a time lag after the hammer strikes the gong, so that after the hammer has struck the gong, the counter-spring pushes said hammer towards an idle position, said means for actuating the damper counter-spring in the strike mode including a stop member arranged on the path of the drive spring.

Specific embodiments of the watch striking mechanism are defined in various dependent claims.

One advantage of the striking mechanism according to this invention lies in the fact that it includes a damper counter-spring which is considered "active", i.e. when the hammer strikes the gong it does not immediately act to push said hammer back towards the idle position. Once the hammer strikes the gong, the counter-spring can be actuated with a time lag via the drive spring abutting a stop member combined with the counter-spring.

Advantageously, the drive spring can take the form of a resilient metal strip or beam secured to the watch plate and with a free end for pushing a stud or shaft of the rotating hammer when the hammer strikes the gong. The hammer is driven in rotation by the drive spring to strike the gong while preserving all the strike energy and without being braked by the counter-spring. This thus ensures an increase in the acoustic level produced when the gong is struck by the hammer. The drive spring may also be braked by contact with the stop member combined with the counter-spring after said hammer has struck the gong. Once the hammer has struck the gong, the counter-spring pushes the hammer towards its idle position to prevent the hammer from rebounding against the gong. In the idle mode, the hammer shaft is kept confined between the free end of the drive spring and one end of the counter-spring.

BRIEF DESCRIPTION OF THE DRAWINGS

The objects, advantages and features of the watch striking mechanism with an active damper counter-spring will appear more clearly in the following description, particularly with reference to the drawings, in which.

DETAILED DESCRIPTION OF THE INVENTION

In the following description, all those parts of the watch striking mechanism combined with the watch movement, which are well known in this technical field, will be only briefly described. The emphasis is mainly placed on the arrangement of the spring elements of the striking mechanism, including the active damper counter-spring. As a result of the various spring elements of said striking mechanism, the hammer loses less energy when it strikes the gong, and there is improved security against any rebounding of the hammer against the gong.

Figure 1:
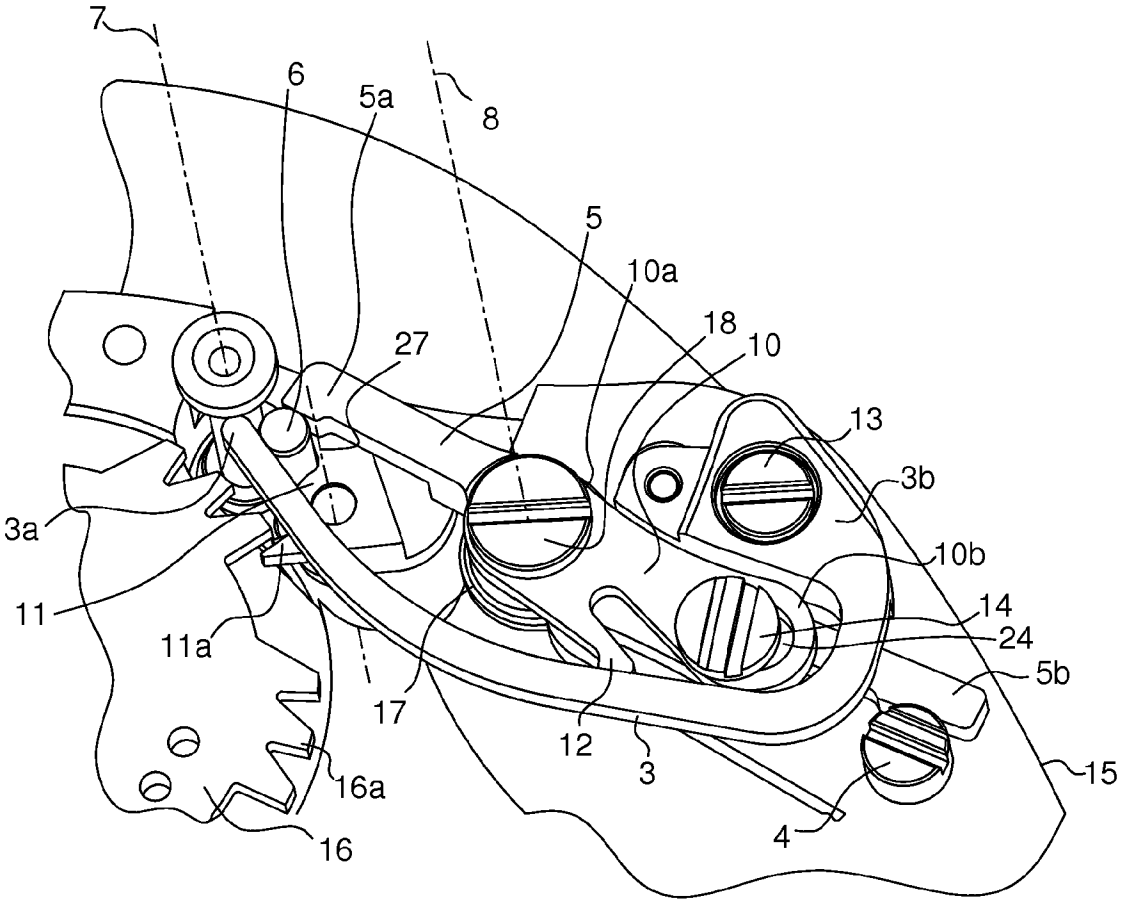
FIG. 1 shows a three-dimensional view of an arrangement of the spring elements of the striking mechanism with an active damper counter-spring according to the invention in an idle mode.

FIG. 1 shows in detail a three-dimensional view of a watch striking mechanism 1. The striking mechanism 1 includes at least one gong, which is secured at one end thereof to a gong-carrier, which is secured to a watch plate 15. The other end of the gong is generally free to move. This striking mechanism 1 also includes at least one hammer rotatably mounted about an axis 7 on the plate in particular in proximity to the gong-carrier. The gong, the gong-carrier and the hammer of striking mechanism 1 are not shown in FIG. 1, since they are on the other side of plate 15. This allows the spring elements shown in FIG. 1 to be changed easily, if necessary.

Striking mechanism 1 further includes a damper counter-spring 5 for holding hammer 2 away from the gong in an idle mode, and a drive spring 3 for the hammer. Drive spring 3 can be wound by a lever 11, explained below, to drive hammer 2 against the gong in a gong striking mode to produce an acoustic sound. Damping counter-spring 5 is defined as active, since it acts on the hammer to return it to the idle position just after the hammer strikes the gong to prevent any loss of energy by the hammer when it is in action. This also increases the quality of the sound produced.

As can be seen in FIG. 1, the hammer drive spring 3 is fixed at one heel-shaped end 3*b* thereof via a screw 13 to watch plate 15. From this heel 3*b*, drive spring 3 has a metal strip or beam, which describes a U shape. This beam 3 surrounds a stop member 10, in the form of a lever, which is combined with damper counter-spring 5 to make the counter-spring active as explained below. This stop member partly acts as means for actuating said counter-spring. This stop member 10 includes a first branch 12, a free end of which is intended to come into contact with an intermediate part of the beam of drive spring 3. The contact of first stop member branch 12 with the intermediate part of spring 3 may occur for example in a portion equal to half the length of the beam from the end 3*b* thereof fixed to plate 15. In an idle mode, the intermediate part of the beam of drive spring 3 remains in direct contact with this end of stop member 10.

The free end 3*a* of the beam of drive spring 3 may be arranged in an idle mode at a slight distance from hammer shaft 6. However, since stop member 10 is combined with counter-spring 5, the first end 5*a* of said counter-spring is actively driven with hammer shaft 6 by stop member 10 against the free end 3*a* of the drive spring in the idle mode. The hammer is thus held at a distance by damper counter-spring 5 abutting against hammer shaft 6, which projects from plate 15 on the side of the spring elements.

Damper counter-spring 5 is formed by a substantially rectilinear lever rotatably mounted about a perpendicular axis 8 to watch plate 15. A first end 5*a* of the lever of counter-spring 5 thus abuts against hammer shaft 6 to hold it at away from the gong in the idle mode. A second end 5*b* of this lever of counter-spring 5 is arranged on an opposite side of the first end 5*a* relative to axis of rotation 8. An eccentric part 4 can be rotatably mounted on plate 15 to act as a rotational stop member for the lever of counter-spring 5.

The first end 5*a* of metal counter-spring 5 can bend slightly in the strike mode just after the hammer strikes the gong via the force applied by drive spring 3 when it is in action, as explained below with reference to FIGS. 2A to 2E. When the hammer strikes the gong, the first end 5*a* of damper counter-spring 5 is momentarily released from hammer shaft 6. This means that the hammer does not lose energy when it is actuated to strike the gong. However, because of metal stop member 10 with branch 12, which is combined with damper counter-spring 5, this first end 5*a* of counter-spring 5 pushes the hammer with a time lag towards its idle position after the hammer has struck the gong.

It is to be noted that, in theory, eccentric part 4 is not used in this embodiment to act as a support point for the lever of counter-spring 5 so that the latter pushes the hammer towards its idle position after the strike. The eccentric part could even be omitted from the striking mechanism. Eccentric part 4 is formed of a wheel which may be in contact with one surface of second end 5*b*. This wheel of eccentric part 4 is mounted off-centre on a rotating pin arranged in a bore in plate 15. The freedom of rotation of counter-spring 5 during the operation in which the hammer strikes the gong can thus be adjusted by rotating this eccentric part 4.

In the embodiment of FIG. 1, stop member 10, in the form of a lever, is mounted along the axis of rotation 8 of counter-spring 5. A screw foot 17 is provided for assembling stop member 10 and counter-spring 5 on plate 15. This screw foot includes a disc at the base thereof secured to plate 15 and on the disc, a tubular part that is smooth on the outside and threaded inside. Lever counter-spring 5 is first of all mounted on screw foot 17 to be supported on the screw foot disc. To do this, counter-spring 5 includes a through opening at axis of rotation 8. The diameter of this through opening is equivalent to the external perimeter of the tubular part to allow the counter-spring to be assembled, for example, without any play on the tubular part. Stop member 10 also includes a through opening in an intermediate portion 10*a*. The diameter of this opening in the stop member is equivalent to the external perimeter of the tubular part of screw foot 17 to allow the stop member to be assembled without any play on the tubular part above counter-spring 5. Once counter-spring 5 and stop member 10 are arranged on the tubular part of screw foot 17, a screw 18 is screwed into the threaded part of the tubular part. This screw 18 is screwed in as far as the mouth of the tubular part, which projects slightly from the opening in stop member 10 which is positioned to maintain the freedom of counter-spring 5 and stop member 10 to rotate on the plate.

A second eccentric part 14 may also be rotatably mounted on counter-spring 5 for adjusting the position of stop member 10 on counter-spring 5. This eccentric part 14 includes a pin inserted in a bore of equivalent diameter made on an intermediate portion of counter-spring 5 between axis of rotation 8 and the second end 5*b* of the counter-spring. Above the pin, the second eccentric part 14 has an off-centre portion placed in another through opening 24 of particular shape at one end 10*b* of a second branch of stop member 10. This off-centre portion is in contact with an inner surface of the other through opening 24 of the stop member. When the second eccentric part 14 is rotated, this allows the free end of the first lever branch 12 of stop member 10 to be moved further away from or closer to the gong. In these conditions, the intermediate part of the pre-wound drive spring 3 comes into contact more or less quickly with the free end of first lever branch 12 of stop member 10 when the hammer strikes the gong. This also has the effect of adjusting the delay in action of counter-spring 5 after the hammer first strikes the gong.

The hammer, actuated by the drive spring at work, is quickly propelled against the gong before the drive spring actuates the counter-spring, via contact on stop member 10, to push the hammer back to its idle position. The time lag before counter-spring 5 acts may be around 2 ms depending upon the configuration of the spring elements and the hammer, and the materials of which they are formed.

In this embodiment, the first and second lever branches of stop member 10 are arranged substantially opposite each other, with a pierced part between the two branches. The rotation of the free end of first branch 12 and the second branch occurs on the same side relative to axis of rotation 8 of stop member 10 and counter-spring 5. On the path of drive spring 3 when the hammer strikes the gong, the intermediate part of the spring comes into contact with the free end of the first lever branch 12 of stop member 10. The second lever branch of stop member 10 is normally provided for driving counter-spring 5 so that the first end 5*a* thereof comes into contact with hammer shaft 6 in the idle mode. After contact with stop member 10 during a strike operation, the remaining movement of drive spring 3 can be estimated at between 0.03 and 0.06 mm. This second lever branch 12 of stop member 10 also brakes the drive spring 3 when it is in action, while activating damper counter-spring 5 to clamp and return hammer shaft 6 to the idle position. This operation is carried out with a time lag relative to the strike of the hammer against the gong.

In an embodiment that is not shown, the base of the first lever branch 12 of stop member 10 can be located at end 10*b* of the stop member, where the second eccentric part 14 is arranged. This gives a pierced part between the two branches of the stop member arranged in reverse fashion to the embodiment shown in FIG. 1. In these conditions, the contact of the end of first branch 12 of stop member 10 with drive spring 3 can occur in a closer part to free end 3*a* thereof. Stop member 10 may also have a simple projecting portion instead of a lever. This projecting portion may be made in the same part between the two through openings in the stop member to come into contact with the intermediate part of drive spring 3. Instead of using a second eccentric part 14 for adjusting the position of stop member 10 on counter-spring 5, the elasticity of first branch 12 could be acted on to adapt the time lag before counter-spring 5 acts.

As shown in FIG. 1, the operation of pre-winding drive spring 3 may be carried out by means of hammer shaft 6, which is driven by a lift member 11 rotatably mounted along an axis of rotation 27 on plate 15. According to an embodiment that is not shown, this lift member 11 may also be mounted on the axis of rotation 7 of the hammer. In a known manner, this lift member 11 has a tooth 11*a* actuated by a toothed wheel 16 rotatably mounted on the plate. The teeth 16*a* of this wheel 16 are arranged in accordance with the desired strike repeater. Thus, lift member 11 can be rotated by toothed wheel 16 in a strike mode to wind drive spring 3 by pushing hammer shaft 6 against free end 3*a* of drive spring 3. When drive spring 3 is in a pre-wound position as described below, damper counter-spring 5 is free to rotate while being limited in rotation by the first eccentric part 4.

Depending upon the material that forms the gong, an initial adjustment has to be carried out by second eccentric part 14 to prevent any rebound when the hammer strikes the gong. For a gold gong compared to a steel gong, the impact portion of the hammer can be arranged further away from the gong. However, because of stop member 10, drive spring 3 can be pre-wound more or less strongly with any type of gong material once the initial adjustment has been carried out.

Various positions of the different spring elements will now be described, before, during and after the strike of the hammer against the gong with reference to FIGS. 2A to 2E. The parts in FIGS. 2A to 2E that are the same as those in FIG. 1 bear the same reference signs. For the sake of simplification, the entire description of these various elements of striking mechanism 1 will not be repeated.

In FIGS. 2A to 2E, the plate has deliberately been removed so that each element of striking mechanism 1 can be observed in various positions for an operation, for example, indicating a programmed alarm time of the watch. Hammer 2, rotatably mounted about axis of rotation 7, and gong 21, one end of which is secured to gong-carrier 22, are clearly shown. All the other elements are similar to those which were described with reference to FIG. 1 and are shown at least in part in FIGS. 2A to 2E.

To improve further the quality of the sound of gong 21 when it is struck by hammer 2, the hammer may be made of a hard material, such as cobalt-tungsten carbide (WCCo), or a ceramic or diamond material. At least the portion 2*a* of hammer 2 that impacts gong 21 should be made of this hard material. Further, the material of said hammer 2 may also have a high density. This increases the energy when the hammer strikes the gong for a given strike speed of the hammer. Damper counter-spring 5 does not cause any loss of energy when the hammer strikes given that it acts after a time lag to return the hammer to the idle position. This counter-spring 5 may also be made of hard metal or steel, like stop member 10, whereas drive spring 3 may be made of conventional spring steel.

Gong 21 can be made in the form of at least one portion of a circle or rectangle. The gong may also be, for example a metal wire of circular or rectangular transverse section, which is generally made of steel or precious metal or metallic glass. This portion of a circle or rectangle conventionally surrounds a part of the watch movement (not shown).

Figure 2A:
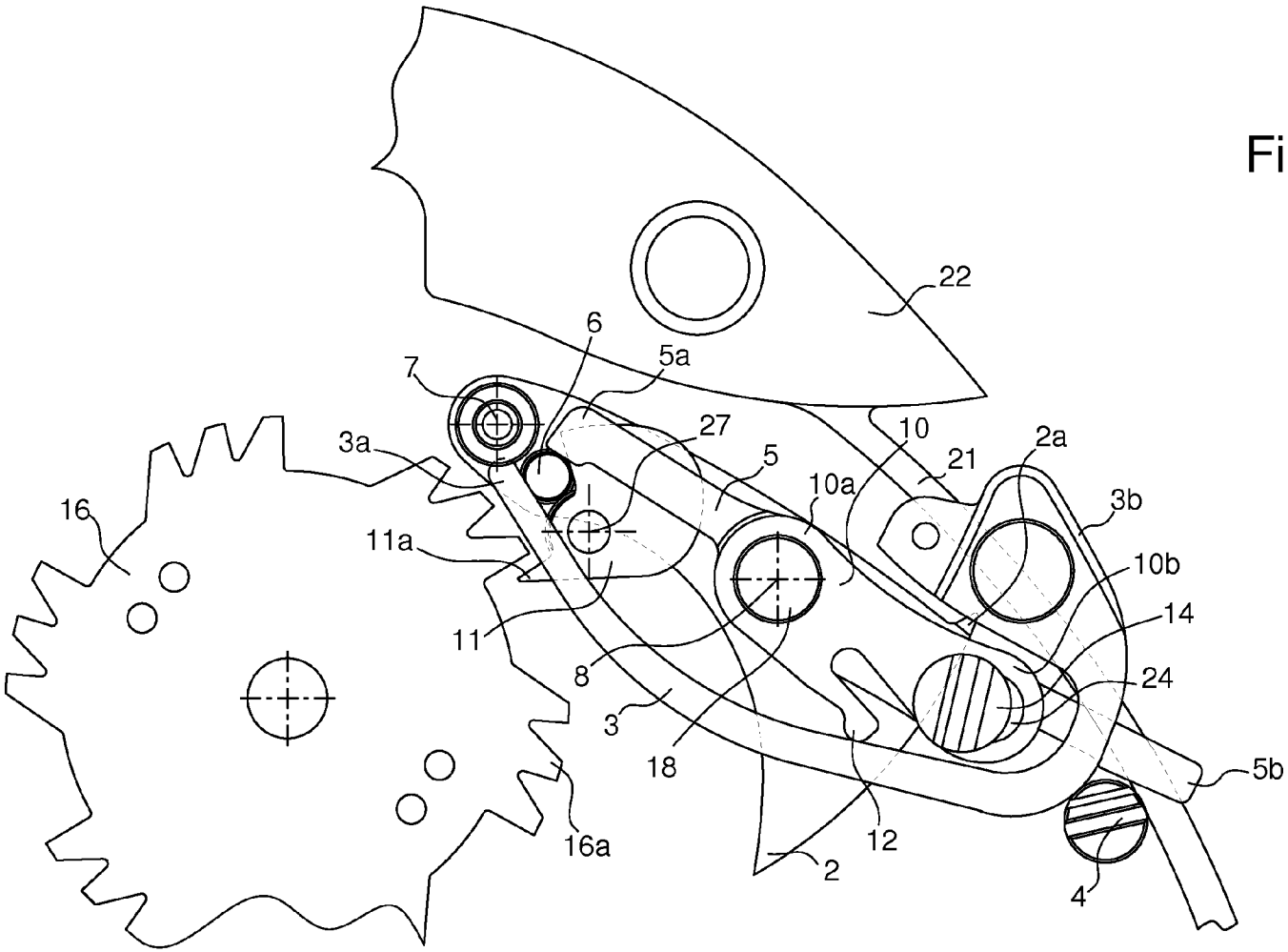
FIGS. 2A to 2E show top views of various positions of the striking mechanism elements, according to the invention, before, during and after the strike of the hammer against the gong.

FIG. 2A shows only a top view of striking mechanism 1 in an idle mode, as previously described with reference to FIG. 1. In this idle position, the free end 3*a* of drive spring 3 and end 5*a* of counter-spring 5 clamp shaft 6 of hammer 2. The end 5*a* of the counter-spring is pushed towards shaft 6 by the pressure of drive spring 3 against the first branch 12 of stop member 10. The impact portion 2*a* of hammer 2 remains away from gong 21. Hammer 2 is also held at a distance by counter-spring 5 and drive spring 3 even in the event of a shock to the watch fitted with this striking mechanism 1.

Figure 2B:
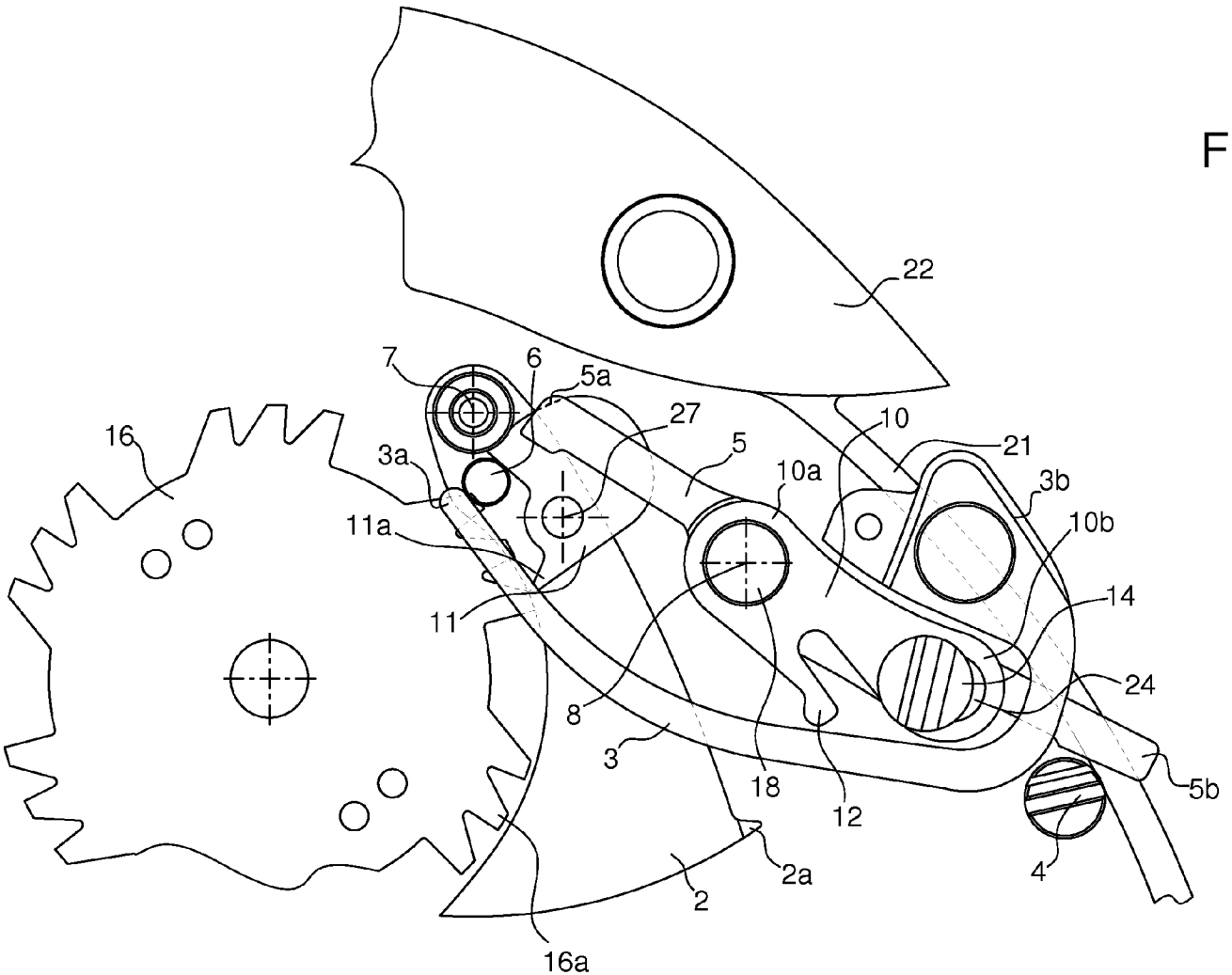

Following the idle mode, drive spring 3 is pre-wound at the start of the striking mode as shown in part in FIG. 2B. Drive spring 3 is dimensioned so that it can be pre-wound with a maximum force of around 1 N. The operation of pre-winding drive spring 3 can be carried out by means of hammer shaft 6, which is driven by a lift member 11 rotatably mounted along an axis of rotation 27 on plate 15. This lift member 11 is driven in rotation via the tooth 11*a* thereof, which is actuated by one of the teeth 16*a* of a toothed wheel 16 rotatably mounted on plate 15. When the spring is in this pre-wound position, impact portion 2*a* of hammer 2, which ends in an edge-shape, is even further away from gong 21. In this position, damper counter-spring 5 and stop member 10 are no longer in contact with shaft 6 of hammer 2 and drive spring 3.

Figure 2C:
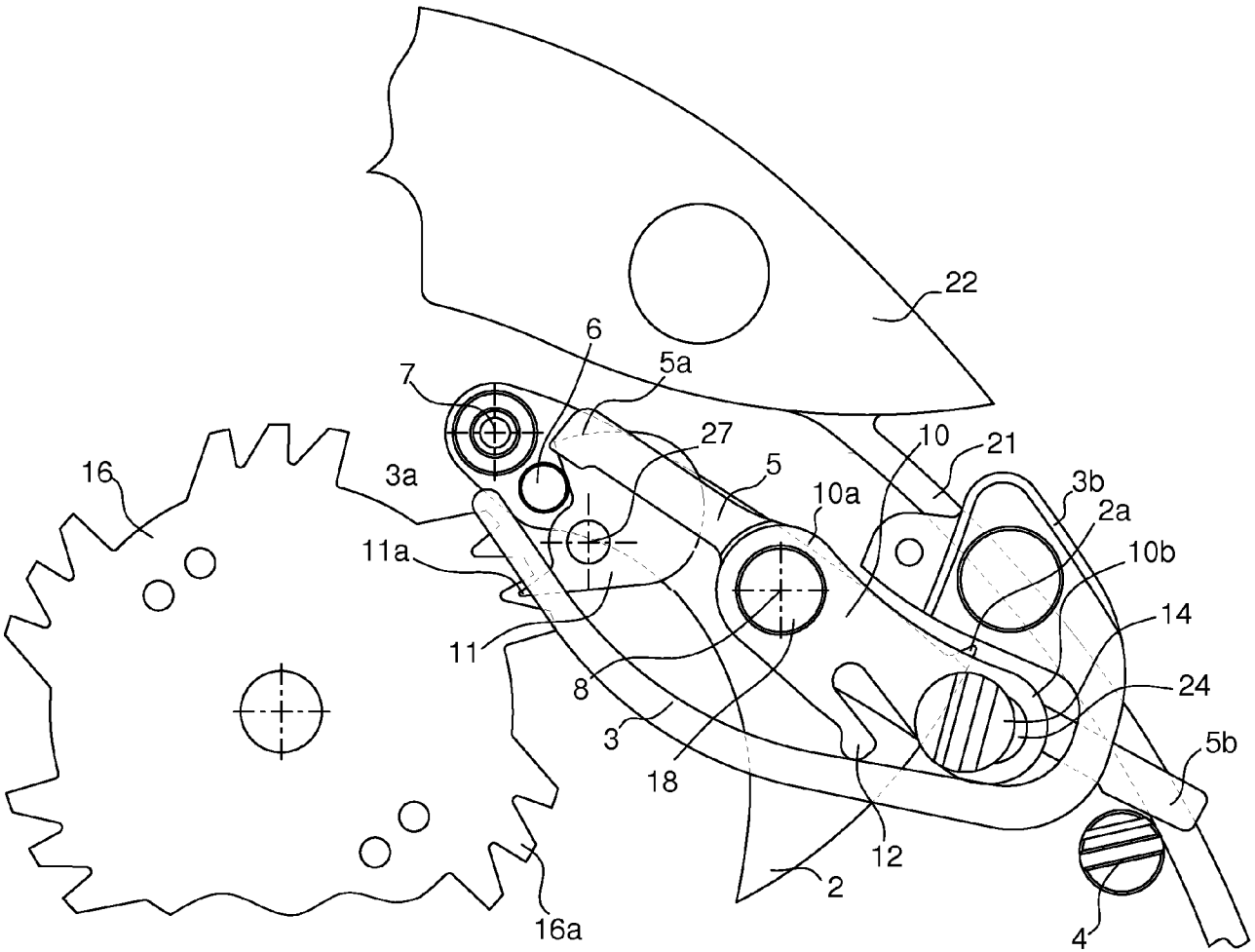

In FIG. 2C, the lift member 11 is released, which allows pre-wound drive spring 3 to drive hammer 2 towards the gong. In this hammer driving phase and under the impulse of drive spring 3, it is noted that the rotational speed of hammer 2 becomes higher than that of the drive spring which comes slightly into contact with the first branch 12 of the stop member. In this case, it is noted in FIG. 2C, that shaft 6 of hammer 2 is no longer in contact with the free end 3*a* of drive spring 3, since the hammer is rotating faster than the drive spring, about its axis of rotation. The damper counter-spring 5 is of course not active and does not brake the hammer as it rotates in the direction of gong 21.

Figure 2D:
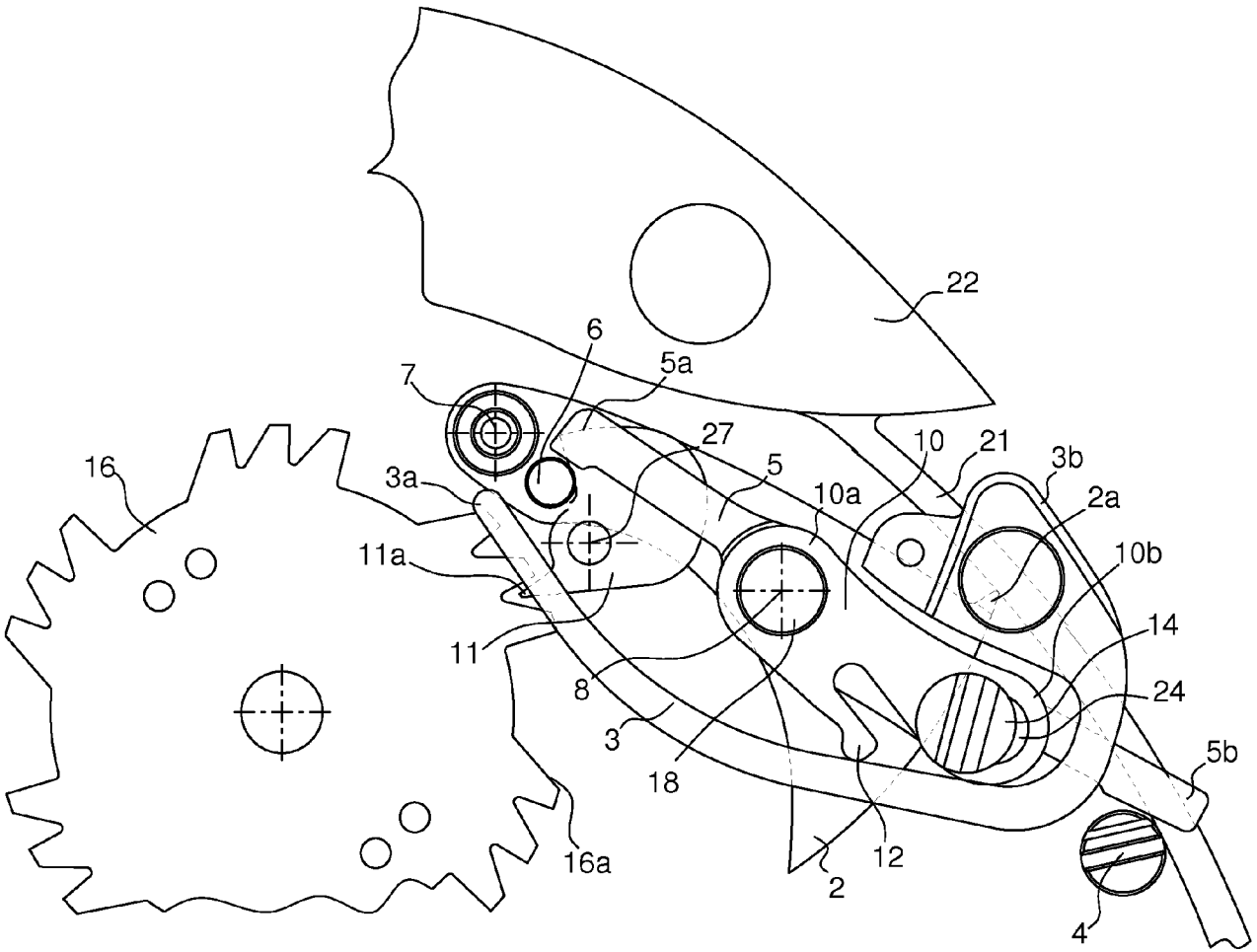

In FIG. 2D, the impact portion 2*a* of hammer 2 strikes gong 21 at its fastest speed, without being braked by counter-spring 5, which increases the quality of the sound produced compared to a conventional striking mechanism. The duration of strike of hammer 2 against gong 21 from the pre-wound position of drive spring 3 may be around 0.2 ms. Drive spring 3 which is in action and in contact with stop member 10, actuates damper counter-spring 5 with a time lag relative to the strike of hammer 2 against gong 21. The time lag may be around 2 ms. Stop member 10 mounted on counter-spring 5 thus plays the part of sensor for triggering counter-spring 5 at the desired time.

Figure 2E:
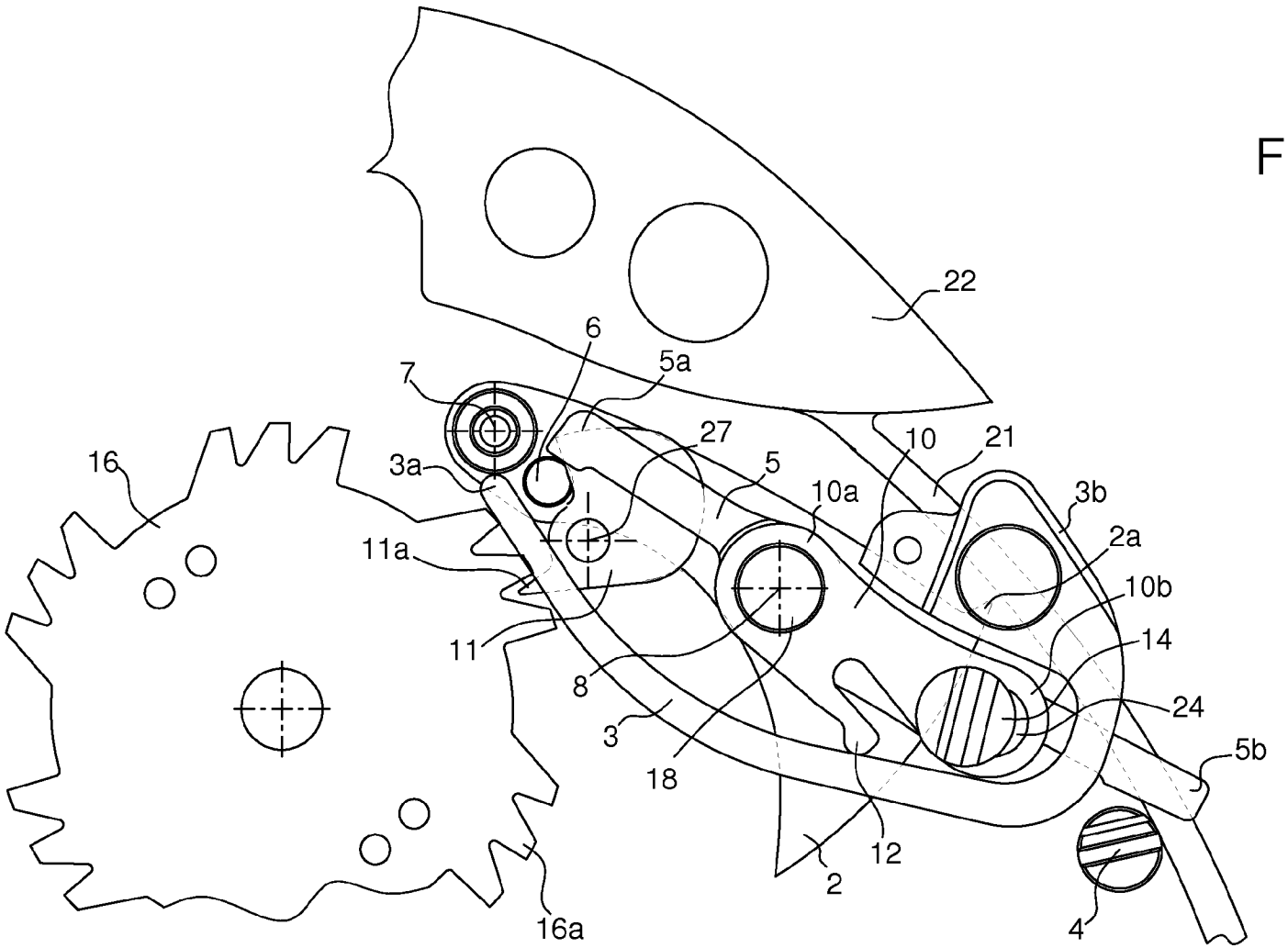

Once the hammer has struck said gong, counter-spring 5 is actuated by drive spring 3 in contact with stop member 10, as shown in FIG. 2E. The activated counter-spring will thus push hammer 2 via shaft 6 thereof towards the idle position. From that moment, damper counter-spring 5 in combination with drive spring 3 prevents the hammer from rebounding against the gong.

From the description that has just been given, several variants of the watch striking mechanism with an active counter-spring can be devised by those skilled in the art without departing from the scope of the invention defined by the claims. The stop member and the counter-spring may form a single piece. Other means may be provided for actuating the counter-spring with a time lag after the hammer strikes the gong. A trigger device may force the counter-spring into a withdrawn position when the drive spring is being pre-wound. This trigger device may release the counter-spring as soon as the hammer first strikes the gong so that the counter-spring pushes the hammer towards the idle position without rebounding against the gong. The hammer may be mounted on the plate to strike the gong along a rectilinear path rather than a rotating path. Several gongs of different lengths may be provided, secured to or integral with the same gong-carrier mounted on the plate or on a portion of the watch case. Each gong can be struck by a respective hammer, where each hammer is driven by its own drive spring. A damper counter-spring combined with a stop member must thus be provided for each hammer.

What is claimed is:

1. A watch striking mechanism, the mechanism including:

a gong that is connected to a gong-carrier, a hammer mounted on a plate to strike the gong at predetermined times, a damper counter-spring disposed to keep the hammer away from the gong in an idle mode, and a drive spring for the hammer that includes a fixed end and an end that is free to move, the spring being able to be wound to drive the hammer against the gong in a strike mode to produce an acoustic sound, means for actuating the damper counter-spring in a strike mode with a time lag after the hammer strikes the gong, so that after the hammer has struck the gong, the counter-spring pushes the hammer towards an idle position, wherein the means for actuating the damper counter-spring in the strike mode includes a lever-shaped stop member arranged on the path of the drive spring, wherein the lever-shaped stop member includes a first branch with a free end of that is arranged to enter into contact with an intermediate part of the drive spring when the hammer strikes the gong, and wherein the stop member is mounted on the counter-spring in order to actuate the counter-spring after the hammer has struck the gong.

2. The striking mechanism according to claim 1, wherein the free end of the spring is intended to drive the hammer against the gong in a strike mode, and wherein an intermediate part of the drive spring in action is intended to enter into contact with the stop member to actuate the damper counter-spring after the hammer has struck the gong.

3. The striking mechanism according to claim 1, wherein the drive spring is configured in the form of a beam or strip spring, so that an intermediate part of the pre-wound spring comes into contact with the stop member to actuate the damper counter-spring after the hammer has struck the gong.

4. The striking mechanism according to claim 1, wherein the damper counter-spring is a lever rotatably mounted along an axis of rotation on the plate, a first end of the lever being used to push the hammer back towards an idle position after the hammer has struck the gong.

5. The striking mechanism according to claim 1, wherein the hammer is rotatably mounted on the plate along an axis of rotation substantially perpendicular to the plane of the plate, and wherein the hammer includes a shaft that is kept in contact with a first end of the counter-spring and the free end of the drive spring in an idle mode, and that is driven by the free end of the drive spring when the spring is in action when the hammer strikes the gong.

6. The striking mechanism according to claim 4, wherein the lever of the counter-spring includes a second rectilinear end on the opposite side to the first end relative to the axis of rotation, and wherein a first eccentric part is rotatably mounted on the plate to act as a rotational stop member for the second end of the counter-spring lever.

7. The striking mechanism according to claim 1, wherein the striking mechanism further comprises:

a lift member rotatably mounted on the plate along an axis of rotation of the hammer or on an axis of rotation parallel to the axis of rotation of the hammer, the lift member being provided to push a shaft of the hammer with the free end of the drive spring to place the spring in a pre-wound position away from the stop member, while placing the damper counter-spring to move freely prior to being able to be actuated after the hammer has struck the gong.

8. The striking mechanism according to claim 1, wherein an intermediate portion of the lever-shaped stop member is mounted along an axis of rotation of the counter-spring to form the base of the first branch of the lever-shaped stop member, wherein the counter-spring is in the form of a lever.

9. The striking mechanism according to claim 8, wherein one end of a second branch of the lever-shaped stop member is connected to the counter-spring by a second eccentric part to adjust the position of the lever-shaped stop member on the counter-spring.

10. The striking mechanism according to claim 1, wherein the stop member and the counter-spring form a single part so that in a strike mode, the stop member immediately actuates the counter-spring via the drive spring which is in action after the hammer has struck the gong.

11. The striking mechanism according to claim 5, wherein a lever of the counter-spring includes a second rectilinear end on the opposite side to the first end relative to the axis of rotation, and wherein a first eccentric part is rotatably mounted on the plate to act as a rotational stop member for the second end of the counter-spring lever.

12. A watch striking mechanism, the mechanism including:

a gong that is connected to a gong-carrier, a hammer mounted on a plate to strike the gong at predetermined times, a damper counter-spring disposed to keep the hammer away from the gong in an idle mode, and a drive spring for the hammer that includes a fixed end and an end that is free to move, the spring being able to be wound to drive the hammer against the gong in a strike mode to produce an acoustic sound, means for actuating the damper counter-spring in a strike mode with a time lag after the hammer strikes the gong, so that after the hammer has struck the gong, the counter-spring pushes the hammer towards an idle position, wherein the means for actuating the damper counter-spring in the strike mode includes a stop member arranged on the path of the drive spring, wherein the stop member and the counter-spring form a single part so that in a strike mode, the stop member immediately actuates the counter-spring via the drive spring which is in action after the hammer has struck the gong.

13. A watch striking mechanism, the mechanism including:

a gong that is connected to a gong-carrier, a hammer mounted on a plate to strike the gong at predetermined times, a damper counter-spring disposed to keep the hammer away from the gong in an idle mode, and a drive spring for the hammer that includes a fixed end and an end that is free to move, the spring being able to be wound to drive the hammer against the gong in a strike mode to produce an acoustic sound, means for actuating the damper counter-spring in a strike mode with a time lag after the hammer strikes the gong, so that after the hammer has struck the gong, the counter-spring pushes the hammer towards an idle position, wherein the means for actuating the damper counter-spring in the strike mode includes a lever-shaped stop member arranged on the path of the drive spring, wherein the lever-shaped stop member includes a first branch with a free end of that is arranged to enter into contact with an intermediate part of the drive spring when the hammer strikes the gong.

* * * * *